US008798513B2

(12) United States Patent
Gon

(10) Patent No.: US 8,798,513 B2
(45) Date of Patent: Aug. 5, 2014

(54) ELECTROMAGNETIC INDUCTION HEATING FIXING APPARATUS AND IMAGE FORMING APPARATUS HAVING THE SAME

(75) Inventor: Syoukou Gon, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 254 days.

(21) Appl. No.: 13/220,952

(22) Filed: Aug. 30, 2011

(65) Prior Publication Data

US 2012/0057909 A1 Mar. 8, 2012

(30) Foreign Application Priority Data

Sep. 6, 2010 (JP) ..... 2010-199166

(51) Int. Cl.
*G03G 15/20* (2006.01)

(52) U.S. Cl.
CPC ..... *G03G 15/2064* (2013.01); *G03G 15/2053* (2013.01); *G03G 2215/2038* (2013.01)
USPC ..... 399/329; 399/328

(58) Field of Classification Search
USPC ..... 399/329
See application file for complete search history.

(56) References Cited

U.S. PATENT DOCUMENTS

| | | | | |
|---|---|---|---|---|
| 6,987,245 | B2 * | 1/2006 | Sanpei et al. | 219/216 |
| 7,388,595 | B2 * | 6/2008 | Yasuda et al. | 347/156 |
| 7,991,337 | B2 * | 8/2011 | Watanabe et al. | 399/328 |
| 2008/0226326 | A1 * | 9/2008 | Seo et al. | 399/69 |
| 2010/0014900 | A1 | 1/2010 | Gon | |
| 2010/0150621 | A1 * | 6/2010 | Sugaya | 399/328 |
| 2010/0329754 | A1 * | 12/2010 | Tamemasa | 399/333 |
| 2012/0148317 | A1 * | 6/2012 | Samei et al. | 399/328 |

FOREIGN PATENT DOCUMENTS

JP 2010-26246 2/2010

* cited by examiner

*Primary Examiner* — Walter L Lindsay, Jr.
*Assistant Examiner* — Philip Marcus T Fadul
(74) *Attorney, Agent, or Firm* — Gerald E. Hespos; Michael J. Porco; Matthew T. Hespos

(57) ABSTRACT

A fixing apparatus includes: a magnetic flux generating source which generates a magnetic flux; an endless belt which inductively generates heat by the magnetic flux while rotating in a prescribed direction; a rotating body which rotates in a prescribed direction and, together with the belt, forms a nip section through which a recording medium carrying a toner image passes; a core which is made of a magnetic material, and directs the magnetic flux to the belt; a heat value adjustment member for adjusting an amount of heat generated in the belt; and a gripping piece which is a non-rotating member, is disposed in a position corresponding to the nip section, and contacts an inner surface of the belt to rotatably grip the belt against the rotating body. The belt is wrapped between the heat value adjustment member and the gripping piece.

19 Claims, 11 Drawing Sheets

ELECTROMAGNETIC INDUCTION HEATING FIXING APPARATUS AND IMAGE FORMING APPARATUS HAVING THE SAME

BACKGROUND OF THE INVENTION

1. Field of the Invention

The present disclosure relates to a fixing apparatus which heats a toner image that has been transferred to a recording medium and thereby fixes the toner image onto the recording medium, and to an image forming apparatus using such a fixing apparatus.

2. Description of the Related Art

The basic constituent elements of an image forming apparatus such as a copying machine, a facsimile machine or a printer include: an image forming section which forms a toner image on an image carrying body (for example, a photosensitive drum); a transfer unit which transfers the toner image on the image carrying body to a sheet, which is one example of a recording medium; and a fixing apparatus which heats and fixes the toner image transferred to the sheet, onto the sheet.

A growing number of fixing apparatuses employ a belt system in which the heat capacity can be set to a low value with a view to shortening the warm-up time at apparatus start-up and reducing energy consumption, etc. Furthermore, attention has been drawn to electromagnetic induction heating (IH) systems, which are capable of very fast heating and high-efficiency heating. An electromagnetic induction heating system excites an induction current in a heating roller or fixing belt, by means of a magnetic flux generated by passing a high-frequency current through an induction coil, and uses the resistance of the actual heating roller or fixing roller itself to produce Joule heat in the heating roller or fixing belt (by induction heating). By means of this Joule heat, the toner image is fixed to a sheet (recording medium) in a nip section between the fixing roller (or fixing belt) and a pressurization roller. A fixing apparatus which combines an electromagnetic induction heating system and a belt system has been developed as a product.

A conventional fixing apparatus which combines an electromagnetic induction heating system and a belt system includes: a fixing belt; a pressurization roller which, together with the fixing belt, forms a nip section through which a sheet carrying a toner image is passed; a fixing roller and a heating roller about which the fixing belt is wrapped; and a coil unit, disposed in a position opposing the heating roller, which lets the fixing belt generate heat by induction heating.

The coil unit includes a plurality of cores which form magnetic paths along which the magnetic flux generated by the coil passes, and a magnetic shielding plate is installed on a center core of these cores. The position of the magnetic shielding plate is switched between a shielding position where the plate is disposed in the magnetic path and shields the magnetic flux, and a withdrawn position where the plate is withdrawn from the magnetic path and does not shield the magnetic flux, in accordance with the amount of rotation of the center core. By appropriately switching the position of the magnetic shielding plate between the shielding position and the withdrawn position in accordance with the size of the sheet which is passed through the nip section, overheating of the fixing belt outside the paper passage region, where the sheet is not in contact with the fixing belt, is suppressed.

However, although a conventional fixing apparatus is able to suppress overheating outside the paper passage region of the fixing belt, it is difficult to shorten the warm-up time of the fixing belt. Since the fixing roller and the heating roller which are wrapped about the fixing belt have a high heat capacity, then a large amount of heat is transferred from the fixing belt that generates heat by induction heating, to the fixing roller and the heating roller. If the amount of heat transfer is large, then the time required until the fixing belt is sufficiently heated increases.

SUMMARY OF THE INVENTION

The object of the present disclosure is to provide a function for suppressing overheating of a fixing belt, while shortening a belt warm-up time.

The fixing apparatus relating to one aspect of the present disclosure which achieves this object is a fixing apparatus including: a magnetic flux generating source which generates a magnetic flux; an endless belt which inductively generates heat by the magnetic flux while rotating in a prescribed direction; a rotating body which rotates in a prescribed direction and, together with the belt, forms a nip section through which a recording medium carrying a toner image passes; a core which is made of a magnetic material, and directs the magnetic flux to the belt; a heat value adjustment member for adjusting an amount of heat generated in the belt; and a gripping piece which is a non-rotating member, is disposed in a position corresponding to the nip section, and contacts an inner surface of the belt to rotatably grip the belt against the rotating body; wherein the belt is wrapped between the heat value adjustment member and the gripping piece.

Furthermore, an image forming apparatus relating to a further aspect of the present disclosure includes: an image forming unit which forms a toner image; a transfer unit which transfers the toner image formed by the image forming unit onto a recording medium; and a fixing apparatus which fixes the toner image onto the recording medium; the fixing apparatus having the composition described above.

BRIEF DESCRIPTION OF THE DRAWINGS

FIG. 2 shows a state in which a magnetic shielding plate is disposed in a restricted shielding position and FIG. 3 shows a state in which a magnetic shielding plate is disposed in a shielding position.

FIG. 5 shows a state in which a heat generating plate is disposed in a heat generating position and FIG. 6 shows a state in which a heat generating plate is disposed in a restricted heat generating position.

FIG. 8 shows a state in which a shielding plate is disposed in a restricted shielding position and FIG. 9 shows a state in which a shielding plate is disposed in a shielding position.

FIG. 10 shows a state in which a heat generating plate is disposed in a heat generating position and FIG. 11 shows a state in which a heat generating plate is disposed in a restricted heat generating position.

DETAILED DESCRIPTION OF THE PREFERRED EMBODIMENTS

Figure 1:
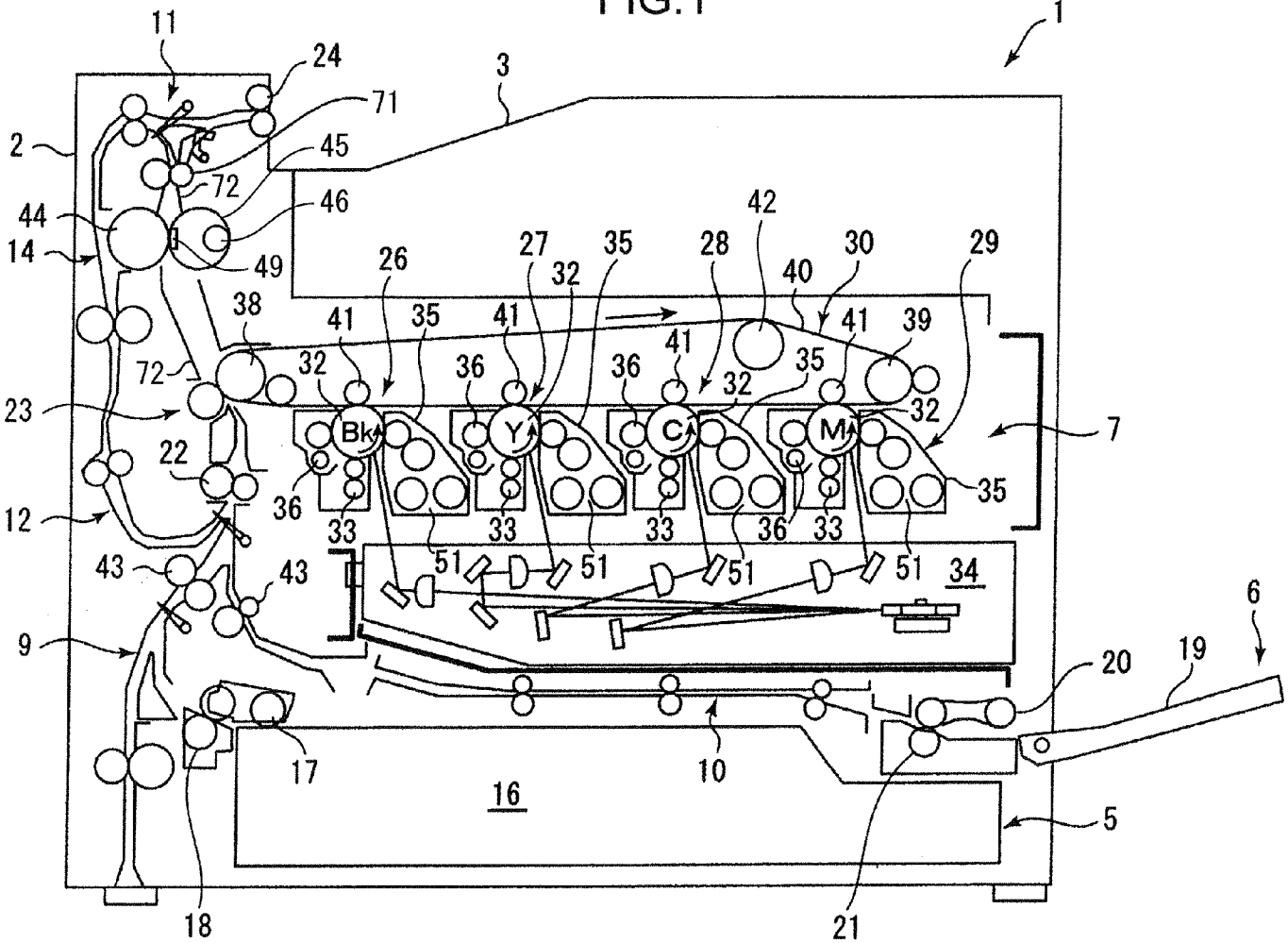
FIG. 1 is a cross-sectional drawing showing a schematic view of an internal structure of an image forming apparatus relating to an embodiment of the present disclosure.

An embodiment of the present disclosure will be described in detail with reference to the drawings. FIG. 1 is a schematic cross-sectional drawing showing the composition of an image forming apparatus 1 according to one embodiment. The image forming apparatus 1 may be implemented as a printer, a copying machine, a facsimile machine, or a multi-functional peripheral combining the functions of these, which performs printing by transferring a toner image onto a surface of a paper sheet T, which is one example of a recording medium, on the basis of image information input from an external source, for example.

The image forming apparatus 1 shown in FIG. 1 is a tandem type color printer. The image forming apparatus 1 includes a square box-shaped apparatus main body 2, inside which a color image is formed on a sheet T. An output tray 3 for receiving a sheet T on which a color image has been printed is provided in the upper surface section of the apparatus main body 2. A paper supply cassette 5 which accommodates sheets T is provided in the lower portion inside the apparatus main body 2. Furthermore, a stacking tray 6 for supplying sheets T manually is provided in the right side face of the apparatus main body 2 as seen in FIG. 1. An image forming section 7 is provided in the upper portion of the apparatus main body 2 and the image forming section 7 forms an image on a sheet T on the basis of image data, such as text characters, pictures, and the like, transmitted from an external source.

A first conveyance path 9 for conveying a sheet T fed from the paper supply cassette 5 to the image forming section 7 is provided in a left position of the image forming section 7 in FIG. 1. A second conveyance path 10 for guiding a sheet T loaded on the stacking tray 6, to the first conveyance path 9, is provided in a position above the paper supply cassette 5. Pairs of conveyance rollers 43 for conveying a sheet T are provided respectively in the first conveyance path 9 and the second conveyance path 10. Furthermore, a fixing apparatus 14 which applies a fixing process to a sheet T on which a toner image has been formed by the image forming section 7, and a third conveyance path 11 for conveying a sheet T which has undergone a fixing process, to the output tray 3, are provided in the upper left portion of the interior of the apparatus main body 2.

The paper supply cassette 5 can be inserted into and removed from the apparatus main body 2, and has an accommodating unit 16. The accommodating unit 16 is capable of selectively accommodating at least two types of sheets T having different sizes in the paper supply direction. Sheets T accommodated in the accommodating unit 16 are fed to the first conveyance path 9, one sheet at a time, by a paper supply roller 17 and a separating roller pair 18.

The stacking tray 6 can be opened and closed with respect to the apparatus main body 2, and sheets T are disposed on a manual feed surface 19 of this stacking tray 6. Sheets T loaded on the manual feed surface 19 are fed to the second conveyance path 10, one sheet at a time, by a pick-up roller 20 and a separating roller pair 21.

The first conveyance path 9 and the second conveyance path 10 converge before a resist roller pair 22. A sheet T which has been conveyed to the resist roller pair 22 waits provisionally in a state of abutting against the resist roller pair 22, and after skew adjustment and timing adjustment, is fed toward a secondary transfer unit 23 (transfer unit). In the secondary transfer unit 23, a full-color toner image on an intermediate transfer belt 40 is secondarily transferred onto the sheet T which has been fed in this way. Thereupon, the sheet T on which the toner image has been fixed by the fixing apparatus 14 is inverted in a fourth conveyance path 12, if necessary, and a full-color toner image is also secondarily transferred onto the opposite surface of the sheet T in the secondary transfer unit 23. After the toner image on the opposite surface has been fixed by the fixing apparatus 14, the sheet T passes along the third conveyance path 11 and is output to the output tray 3 by an output roller pair 24.

The image forming section 7 includes four image forming units 26 to 29 which form respective toner images of black (Bk), yellow (Y), cyan (C) and magenta (M), and an intermediate transfer unit 30 which carries, in mutually superimposed fashion, the toner images of the respective colors formed by the image forming units 26 to 29.

The image forming units 26 to 29 each include: a photosensitive drum 32 (image carrying body); a charger 33 which is disposed so as to oppose the circumferential surface of the photosensitive drum 32; a laser scanning unit 34 which irradiates a laser beam onto a specific position on the circumferential surface of the photosensitive drum 32 on the downstream side of the charger 33 in terms of the direction of rotation of the photosensitive drum 32; a developing apparatus 35 which is disposed so as to oppose the circumferential surface of the photosensitive drum 32 on the downstream side of the laser beam irradiation position from the laser scanning unit 34 in terms of the direction of rotation of the photosensitive drum 32; and a cleaner 36 which is disposed so as to oppose the circumferential surface of the photosensitive drum 32 on the downstream side of the developing apparatus 35 in terms of the direction of rotation of the photosensitive drum 32.

The photosensitive drums 32 of the image forming units 26 to 29 rotate in the counter-clockwise direction in the drawings, by means of a drive motor which is not illustrated. The developing apparatuses 35 of the respective image forming unit 26 to 29 each include a development vessel 51 which accommodates a two-component developer, respectively containing black toner, yellow toner, cyan toner and magenta toner.

The intermediate transfer unit 30 includes: a drive roller 38 which is disposed in a position in the vicinity of the image forming unit 26; a driven roller 39 which is disposed in a position in the vicinity of the image forming unit 29; a tension roller 42 which is disposed in a position between the drive roller and the driven roller 39; an intermediate transfer belt 40 which is disposed about the drive roller 38, the driven roller 39 and the tension roller 42; and four transfer rollers 41 which are disposed so as to be able to press against the photosensitive drums 32 of the respective image forming units 26 to 29, via the intermediate transfer belt 40.

In the intermediate transfer unit 30, toner images of respective colors are transferred in a mutually superimposed state from the photosensitive drums 32, onto the intermediate transfer belt 40, at the positions of the transfer rollers 41 of the image forming units 26 to 29, thereby forming a full-color toner image.

Viewed in terms of the sheet conveyance direction, a conveyance path 72 is provided on the upstream side and the downstream side of the fixing apparatus 14. A sheet T which is conveyed via the secondary transfer unit 23 passes along the upstream-side conveyance path 72 and is guided to the fixing apparatus 14. A sheet T which has undergone a fixing process passes along the downstream-side conveyance path 72 and is guided to the third conveyance path 11.

The third conveyance path 11 guides a sheet T which has undergone a fixing process in the fixing apparatus 14, to the output tray 3. A conveyance roller pair 71 for conveying the sheet T to the output tray 3 is provided in the third conveyance path 11, and furthermore the output roller pair 24 described above is provided at the outlet of the third conveyance path 11.

First Embodiment

Figure 2:
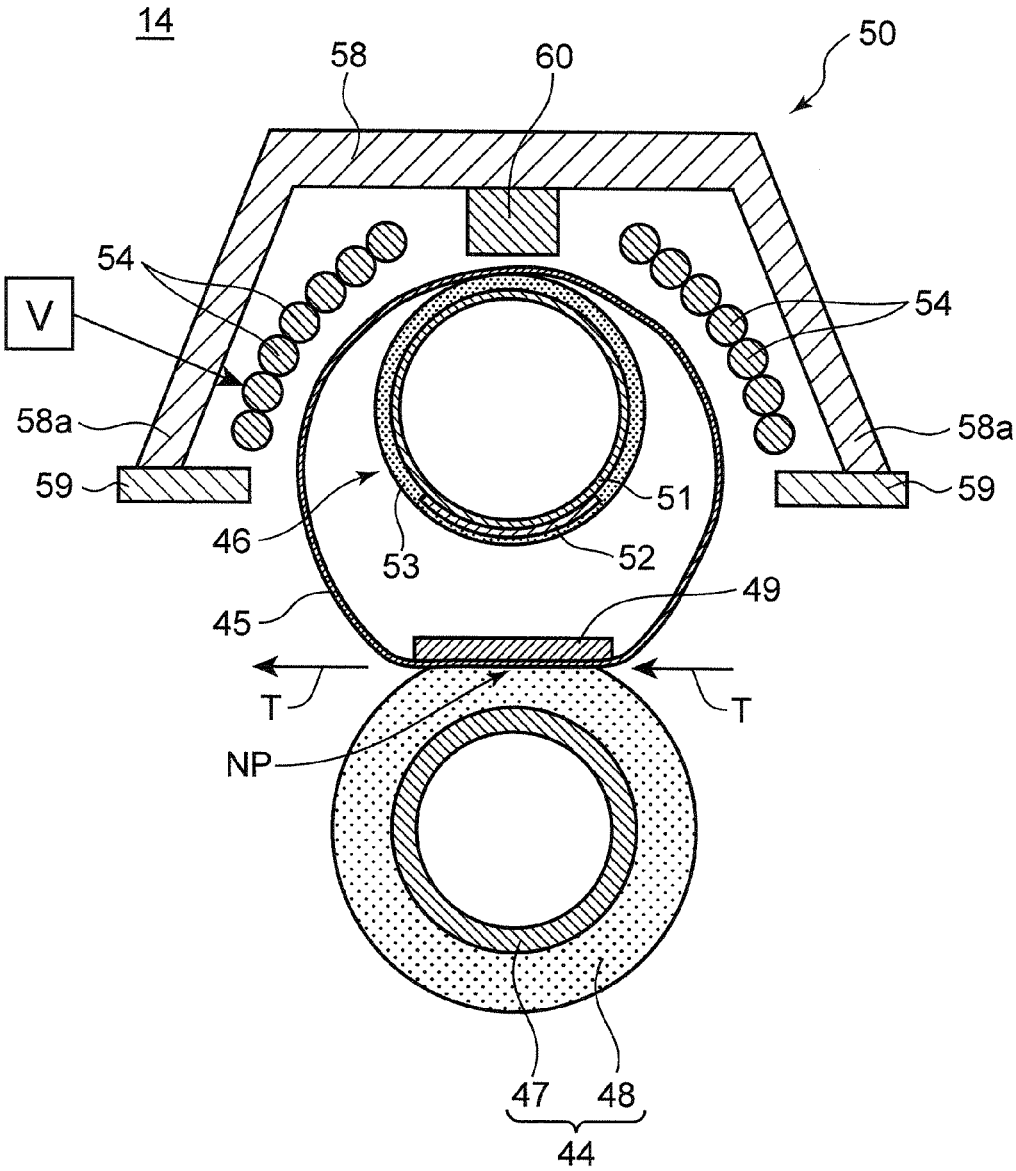
FIGS. 2 and 3 are longitudinal cross-sectional diagrams of a fixing apparatus relating to the first embodiment, where

Next, a fixing apparatus 14 relating to a first embodiment is described with reference to FIG. 2. FIG. 2 is a vertical cross-sectional diagram of a fixing apparatus 14. The fixing apparatus 14 carries out a fixing process for fixing a toner image to a sheet T, by applying heat and pressure to the toner image which has been transferred to the sheet T. The fixing apparatus includes a pressurization roller 44 (rotating body), a fixing belt 45 (endless belt), a gripping piece 49, a heat value adjustment member 46, and a coil unit 50.

The pressurization roller 44 is a roller member capable of rotating in the counter-clockwise direction in FIG. 2, and is constituted by a tubular stainless steel core member 47, a silicone rubber elastic layer 48 which is laminated onto the core member 47, and a PFA surface separating layer (not illustrated), which is laminated onto the elastic layer 48. A heat source, such as a halogen heater, may be arranged inside the core member 47. The elastic layer 48 can be heated by this heat source.

The fixing belt 45 is an endless belt which is wrapped about the gripping piece 49 and the heat value adjustment member 46, and is capable of rotating in the clockwise direction in FIG. 2. The pressurization roller 44 is pressed towards the fixing belt 45 by a biasing member (not illustrated), and a nip section NP through which a sheet T carrying a toner image passes is formed between the pressurization roller 44 and the fixing belt 45. The fixing belt 45 has a width dimension in a direction perpendicular to the conveyance direction of the sheet T passing through the nip section NP.

The fixing belt 45 includes an electroplated nickel base member which faces the interior of the fixing belt 45, a silicone rubber elastic layer which is laminated onto the base member, and a PFA surface separating layer, which is layered on the elastic layer. The thickness of the base member is 30 to 50 μm, for example, and the thickness of the elastic member is 200 to 500 μm, for example. The thickness of the surface separating layer is approximately 30 μm, for example.

The gripping piece 49 is disposed inside the fixing belt 45 and contacts the inner surface of the fixing belt 45 (in other words, the base member), at a position corresponding to the nip section NP, thereby gripping the fixing belt 45 in rotatable fashion, against the pressurization roller 44. The gripping piece is a flat plate-shaped member which extends along the nip section NP in parallel with the pressurization roller 44, and has a width direction dimension extending along the conveyance direction of the sheet T. A portion of the circumferential surface of the pressurization roller 44 deforms elastically in a flat shape due to being pressed against the flat plate-shaped gripping piece 49, and a portion of the fixing belt 45 also deforms to a flat planar shape following the flat plate-shaped gripping piece 49. By this means, a straight line-shaped nip section NP having a prescribed length in the conveyance direction of the sheet T is formed. The width direction dimension of the gripping piece 49 in a longitudinal cross-section is set in such a manner that the nip section NP has a sufficient nip width in the conveyance direction of the sheet T, as well as so as to enable the gripping piece to exert sufficient gripping force against the fixing belt 45. Furthermore, the gripping piece 49 is a member which is in a fixed non-rotating position, in contrast to the roller member.

The gripping piece 49 serves to rotatably support the fixing belt 45 in a state of contact with the base member of the fixing belt 45, and therefore the material of the gripping piece 49 is selected from materials which give suitable rigidity to the gripping piece 49 with respect to the fixing belt 45. Furthermore, surface treatment may also be applied to the surface of the gripping piece 49 in order to lower the friction between the gripping piece 49 and the fixing belt 45.

The gripping piece 49 need only be a member capable of exerting sufficient gripping force with respect to the fixing belt 45, and therefore may be formed to small dimensions. Consequently, the heat capacity of the gripping piece 49 can be reduced. The gripping piece 49 is not limited to a flat plate shape, provided that it is capable of ensuring a sufficient nip width and exerting sufficient gripping force with respect to the fixing belt 45.

The heat value adjustment member 46 is a member which is disposed inside the fixing belt 45, and which adjusts the amount of heat generated in the fixing belt 45 by adjusting the amount of magnetic flux guided from the coil unit 50 to the fixing belt 45. The heat value adjustment member 46 is also used as a member about which the fixing belt 45 is wrapped. In the first embodiment, the heat value adjustment member 46 includes a base member 51, a magnetic shielding plate 52, and a coating layer 53.

The base member 51 is a member having a cylindrical shape which is made of a magnetic material, such as iron or stainless steel, and extends in parallel with the pressurization roller 44 and is disposed in a position opposing the pressurization roller 44 via the nip section NP and the gripping piece 49. The base member 51 is made of a magnetic material, and therefore is able to generate heat by the magnetic flux from the coil unit 50. The base member 51 is a thin member having a thickness of 0.3 to 1.0 mm, for example.

The base member 51 is composed so as to be rotatable in a prescribed direction. The heat value adjustment member 46 sets the position of the fixing belt 45 with respect to the coil unit 50 by contacting the inner surface of the fixing belt 45 from the opposite direction to the direction in which the gripping piece 49 applies a gripping force to the fixing belt 45. The fixing belt has intrinsic rigidity, and therefore the fixing belt 45 is supported by the heat value adjustment member 46 in a position opposing the center core 60 of the coil unit 50, which is described below, and in a position in the vicinity thereof. Therefore, the fixing belt 45 does not contact the outer circumferential surface of the base member 51 (coating layer 53) except for at the position where the base member 51 opposes the center core 60 and a position in the vicinity thereof.

The fixing belt 45 which is wrapped about the heat value adjustment member 46 and the gripping piece 49 is driven to rotate in the clockwise direction due to the pressurization roller 44 rotating in the counter-clockwise direction in FIG. 2 by means of a drive source, which is not illustrated.

Figure 3:
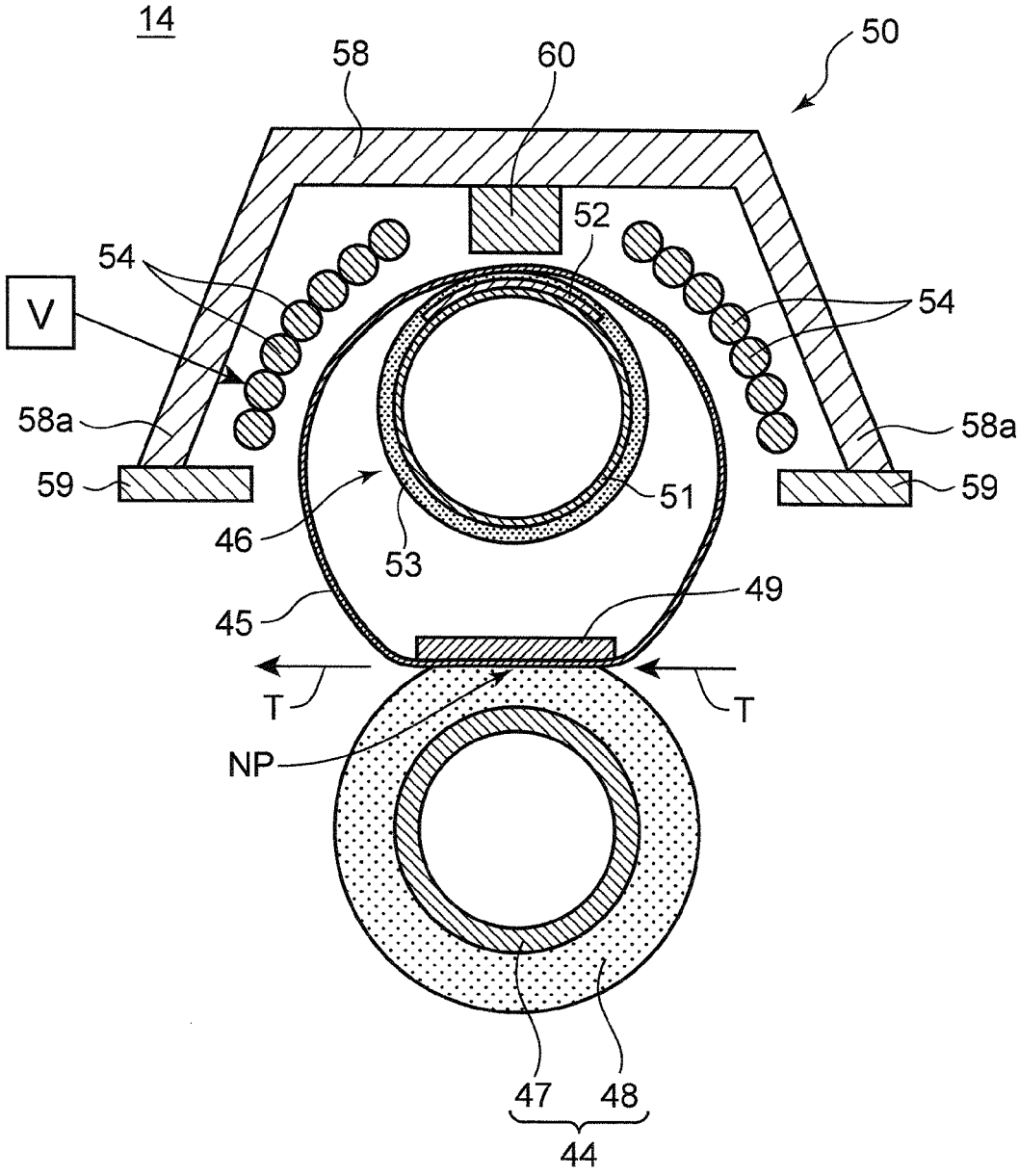

The magnetic shielding plate 52 is a thin plate-shaped member made of a non-magnetic material having high conductivity, such as copper or aluminum, and is installed on the outer circumferential surface of the base member 51. The thickness of the magnetic shielding plate 52 is 0.3 to 1.0 mm, for example. The position of the magnetic shielding plate 52 is switched between a shielding position and a restricted shielding position, in accordance with rotation of the base member 51. FIG. 2 shows a state where the magnetic shielding plate 52 is positioned in the restricted shielding position and FIG. 3 shows a state where the magnetic shielding plate 52 is positioned in the shielding position. When positioned in the shielding position, the magnetic shielding plate 52 is moved to a position near the coil unit 50, and in particular, a position in the vicinity of the center core 60, and thereby shields or suppresses the magnetic flux. On the other hand, when positioned in the restricted shielding position, the magnetic shielding plate 52 is in a position which is distant from the center core 60. Therefore, the shielding of the magnetic flux is weakened. The magnetic shielding plate 52 cancels out the magnetic flux which seeks to pass through the fixing belt 45, by generating a reverse magnetic flux when the magnetic flux from the center core 60 passes through the fixing belt 45.

Figure 4:
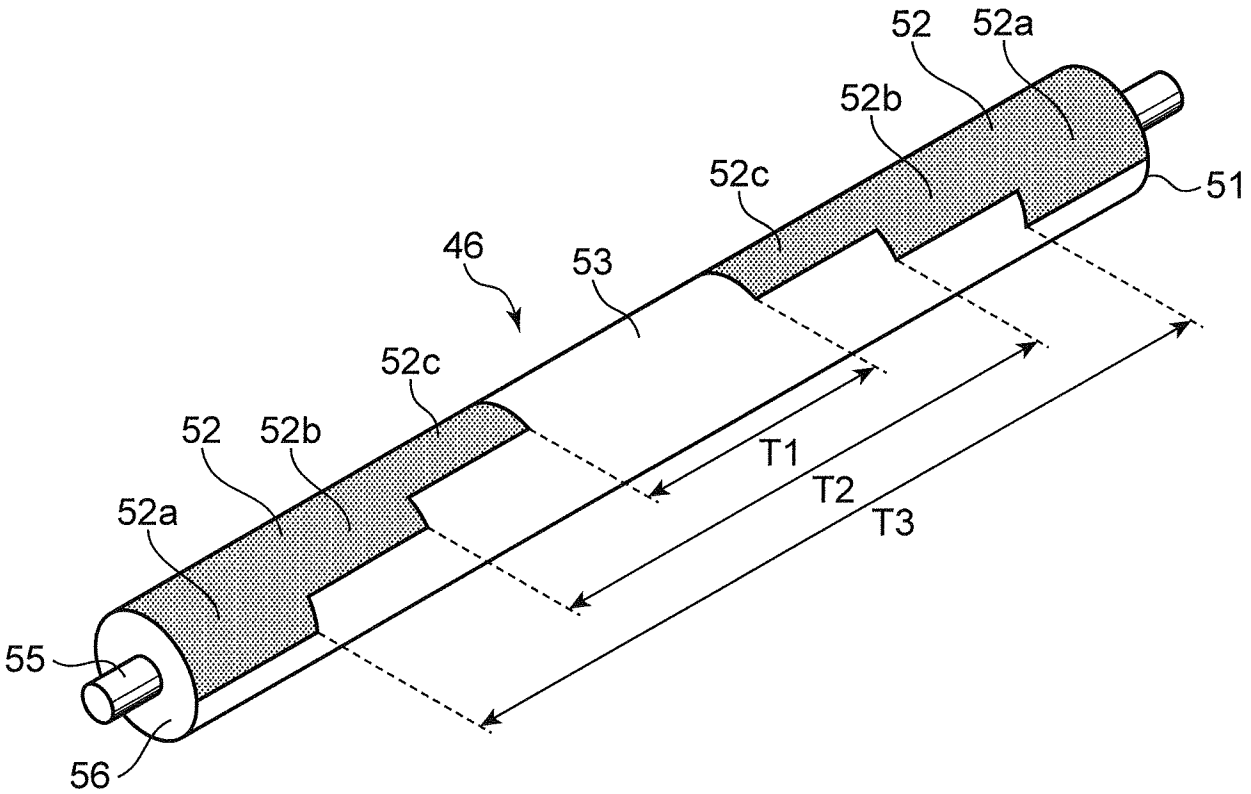
FIG. 4 is a perspective diagram of a heat value adjustment member which is used in a fixing apparatus according to the first embodiment.

FIG. 4 is a perspective diagram of the heat value adjustment member 46. As shown in FIG. 4, a magnetic shielding plate 52 is installed on the outer circumferential surface of the base member 51 in the respective end portions in the axial direction. The pair of magnetic shielding plates 52 have laterally symmetrical shapes, and each magnetic shielding plate 52 is designed in such a manner that the circumferential dimension thereof in the circumferential direction of the base member 51 gradually becomes smaller in the inward axial direction of the base member 51. More specifically, the magnetic shielding plates each include: a large shielding portion 52*a* located in the endmost portion of the axial direction of the base member 51; a medium shielding portion 52*b* located in the inward axial direction of the base member 51 from the large shielding portion 52*a*; and a small shielding portion 52*c* located in the inward axial direction of the base member 51 from the medium shielding portion 52*b*. The large shielding portion 52*a*, the medium shielding portion 52*b* and the small shielding portion 52*c* are formed in an integrated fashion.

The large shielding portions 52*a*, the medium shielding portions 52*b* and the small shielding portions 52*c* correspond respectively to the width dimensions of sheets T which pass through the nip section NP (the sizes of the sheets T in the direction perpendicular to the conveyance direction of the sheet T in the nip section NP). The distance between the pair of small shielding portions 52*c* corresponds to a sheet T1 having a minimum width dimension (for example, an A5 sheet). The distance between the pair of medium shielding portions 52*b* corresponds to a sheet T2 having a medium width dimension (for example, an A4 sheet (portrait)). The distance between the pair of large shielding portions 52*a* corresponds to a sheet T3 having a maximum width dimension (for example, an A3 sheet). Moreover, the respective circumferential dimensions of the large shielding portions 52*a*, the medium shielding portions 52*b* and the small shielding portions 52*c* in the circumferential direction of the base member 51 are set to dimensions which enable shielding of the magnetic flux directed to the fixing belt 45 by the center core 60 when the magnetic shielding plates 52 are positioned in the shielding position.

The base member 51 of the heat value adjustment member 46 also includes flanges 56 which close off the respective end portions in the axial direction, and rotating shaft members 55 which pass through the flanges 56. By means of the rotating shaft member 55 rotating in a prescribed direction by means of a drive source (not illustrated), the position of the magnetic shielding plates 52 is switched between the shielding position and the restricted shielding position.

The coating layer 53 is formed over substantially the whole of the surface of the heat value adjustment member 46 which contacts the inner surface of the fixing belt 45, in other words, the surface of the base member 51 and the surfaces of the magnetic shielding plates 52. The coating layer 53 is made of fluorine resin and reduces the friction between the surface of the heat value adjustment member 46 and the inner surface of the fixing belt 45. In FIG. 2 and FIG. 3, the thickness of the coating layer 53 is depicted in exaggerated fashion.

The coil unit 50 serves to let the base member 51 of the fixing belt 45 generate heat by induction heating and includes a coil 54 (magnetic flux generating source), arch cores 58, a pair of side cores 59, and a center core 60.

The coil 54 is a winding which is disposed so as to oppose the outer circumferential surface of the fixing belt 45 at a position opposite to the pressurization roller 44 with respect to the fixing belt 45, and this winding has a linear portion following the width direction of the fixing belt 45. The coil 54 is supported by a bobbin (not illustrated) in a state where the coil is separated by a prescribed distance from the fixing belt 45. The wiring region of the coil 54 is set to a size which exceeds the width dimension of the fixing belt 45. Furthermore, the coil 54 is connected to an AC bias power source V, and when an AC bias is applied to the coil 54, the coil 54 generates a magnetic flux.

The arch cores 58, the pair of side cores 59 and the center core 60 are ferrite cores which create a magnetic path along which the magnetic flux generated by the coil 54 passes. The arch cores 58 have an arch shape which extends through a range exceeding the winding region of the coil 54. The arch cores 58 are held by a core holder made of heat-resistant resin (for example, PPS, PET, LCP), which is not illustrated.

The arch cores 58 have a pair of free ends 58*a* which are disposed on either side of the coil 54 and which extend in the direction of extension of coil 54, and each of the pair of side cores 59 is connected to the corresponding free ends 58*a*. The side cores 59 are also held by a core holder made of a heat-resistant resin, which is not illustrated.

The center core 60 is a core which is installed on the arch cores 58 so as to be disposed between the arch cores 58 and the fixing belt 45 from the viewpoint of the magnetic path. The center core 60 extends in the direction of extension of an arrangement area of arch cores 58 and opposes the fixing belt 45 in the region where the coil 54 is not present. The center core 60 guides the magnetic flux passing through the arch core 58 to the fixing belt 45. The center core 60 and the magnetic shielding plates 52 of the heat value adjustment member 46 are situated in closest mutual proximity when the magnetic shielding plates 52 are in the shielding position.

Next, the fixing operation by the fixing apparatus 14 having the composition described above will be explained. When an AC bias is applied to the coil 54 from the AC bias power source V, the coil 54 generates a magnetic flux. The magnetic flux passes along a magnetic path formed between the fixing belt 45, the side cores 59, the arch cores 58 and the center core 60. When the magnetic flux passes through the fixing belt 45, an induction current is generated. When the induction current is passed through the fixing belt 45, Joule heat is generated by the intrinsic resistance of the fixing belt 45 itself, in other words, induction heating occurs in the fixing belt 45. The whole of the fixing belt 45 inductively generates heat as the belt rotates. Furthermore, the base member 51 of the heat value adjustment member 46 generates heat by the passage of magnetic flux.

Before causing the fixing belt 45, and the like, to generate heat, the base member 51 of the heat value adjustment member 46 is rotated appropriately by rotational force applied to the rotational shaft member 55, in accordance with the width dimension of the sheet T. By this means, the large shielding portions 52*a* to the small shielding portions 52*c* of the magnetic shielding plate 52 are switched between a shielding position where they are situated in the magnetic path and shield or suppress the magnetic flux, and a restricted shielding position where they are withdrawn from the magnetic path and shielding of the magnetic flux is weakened.

For example, in the case of a sheet T1 having a minimum width dimension which is passing through the nip section NP, the base member 51 of the heat value adjustment member 46 is rotated in such a manner that all of the large shielding portions 52*a* to the small shielding portions 52*c* of the magnetic shielding plate assume a shielding position. Consequently, only the paper passage region of the fixing belt 45 which is in contact with the sheet T1 in the nip section NP generates heat by induction heating without restriction of generating heat, whereas in the region outside the paper passage region of the fixing belt 45 which is not in contact with the sheet T1 in the nip section NP, induction heating is restricted.

Moreover, in the case of a sheet T2 having a medium width dimension which is passing through the nip section NP, the base member 51 is rotated in such a manner that the small shielding portions 52*c* of the heat value adjustment member 46 assume a restricted shielding position, whereas the medium shielding portions 52*b* and the large shielding portions 52*a* assume a shielding position. Consequently, only the paper passage region of the fixing belt 45 which is in contact with the sheet T2 in the nip section NP generates heat by induction heating without restriction of generating heat, whereas in the region outside the paper passage region of the fixing belt 45 which is not in contact with the sheet T2 in the nip section NP, induction heating is restricted.

Furthermore, in the case of a sheet T3 having a maximum width dimension which is passing through the nip section NP, the base member 51 is rotated in such a manner that the small shielding portions 52*c* and the medium shielding portions 52*b* of the heat value adjustment member 46 assume a restricted shielding position, whereas the large shielding portions 52*a* assume a shielding position. Consequently, only the paper passage region of the fixing belt 45 which is in contact with the sheet T3 in the nip section NP generates heat by induction heating without restriction of generating heat, whereas in the region outside the paper passage region of the fixing belt 45 which is not in contact with the sheet T3 in the nip section NP, induction heating is restricted.

In this way, by suitably rotating the heat value adjustment member 46 in such a manner that induction heating is restricted in the region outside the paper passage region on the fixing belt 45, the small shielding portions 52*c* to the large shielding portions 52*a* are switched between a shielding position and a restricted shielding position. By this means, the amount of magnetic flux directed to the fixing belt 45, in other words, the amount of heat generated in the fixing belt 45 is adjusted, and overheating of the region outside the paper passage region of the fixing belt 45 is suppressed. The positional relationship between the small shielding portions 52*c* to the large shielding portions 52*a* is set in such a manner that the small shielding portions 52*c* to the large shielding portions 52*a* can suitably be positioned at a shielding position or a restricted shielding position, in accordance with the sheets T1 to T3.

When any one of the sheets T1, T2 or T3 enters into the nip section NP following the conveyance direction of sheet T, the toner image on any one of the sheet T1, T2 or T3 receives heat from the fixing belt 45 while being gripped between the fixing belt 45 and the pressurization roller 44. By this means, the toner image is fixed onto the sheet.

A thermistor (not illustrated) is provided in a position in the vicinity of the fixing belt 45. The thermistor detects the surface temperature of the fixing belt 45. The surface temperature thus detected is sent to a control unit, which is not illustrated. The control unit controls the AC bias power source V on the basis of the surface temperature of the fixing belt 45, and adjusts the density of the magnetic flux generated by the coil 54.

According to the fixing apparatus 14 relating to the first embodiment described above, the fixing belt 45 is wrapped between a gripping piece 49 and a heat value adjustment member 46. The gripping piece 49 is a non-rotating member which rotatably grips the fixing belt 45 against the pressurization roller 44, at a position corresponding to the nip section NP, and it has a small heat capacity. The heat value adjustment member 46 is a member which, together with the gripping piece 49, rotatably supports the fixing belt 45 while applying tension to the fixing belt 45. Consequently, it is possible to reduce the amount of heat transferred to the other members from the fixing belt 45 which generates heat by using induction heating, compared to a conventional composition having a fixing belt which rotates by being wrapped about two roller members having a large heat capacity (for example, a fixing roller and a heating roller). Accordingly, it is possible to shorten the warm-up time of the fixing belt 45. Furthermore, the heat value adjustment member 46 about which the fixing belt 45 is wrapped is a member which is used in order to adjust the amount of the magnetic flux directed to the fixing belt 45, and therefore the fixing apparatus 14 has a function for suppressing overheating of the fixing belt 45.

Moreover, a coating layer 53 is formed on the surface of the heat value adjustment member 46, and therefore the slidability of the fixing belt 45 with respect to the heat value adjustment member 46 is improved. By this means, the fixing belt 45 can rotates smoothly.

Moreover, since the heat value adjustment member 46 is constituted by a thin base member 51 and thin plate-shaped magnetic shielding plates 52, then the amount of heat transferred to the heat value adjustment member 46 from the fixing belt 45 generating heat by induction heating is small.

Furthermore, since the base member 51 of the heat value adjustment member 46 has a cylindrical shape, it is possible to rotate the magnetic shielding plates 52 in a 360° angular range. Therefore, the magnetic shielding plates 52 of the heat value adjustment member 46 can be switched easily between a shielding position and a restricted shielding position.

Second Embodiment

Figure 5:
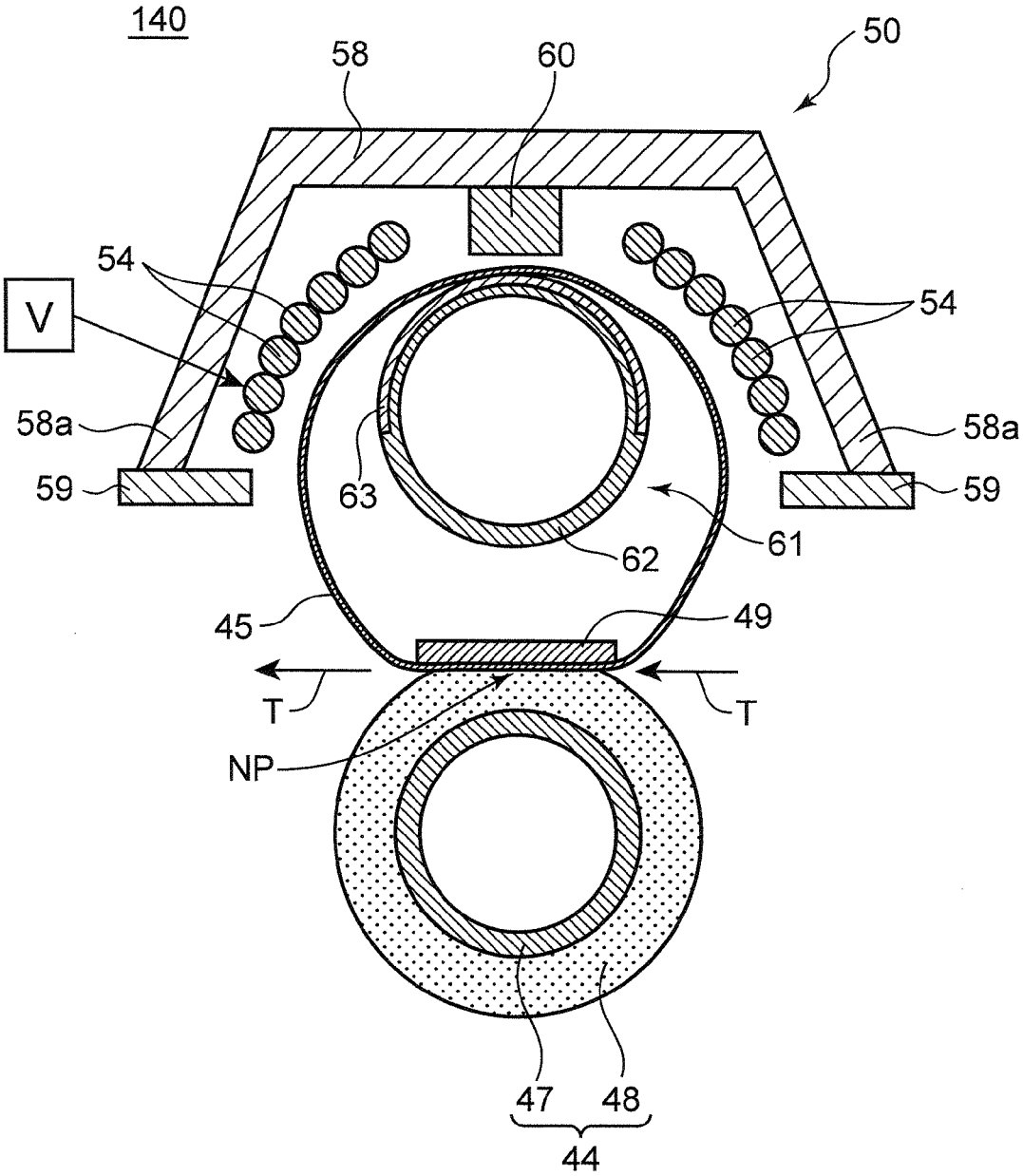
FIGS. 5 and 6 are longitudinal cross-sectional diagrams of a fixing apparatus relating to a second embodiment, where

Next, a fixing apparatus 140 relating to a second embodiment is described with reference to FIG. 5. FIG. 5 is a vertical cross-sectional diagram of a fixing apparatus 140. Similarly to the fixing apparatus 14 according to the first embodiment, the fixing apparatus 140 includes a pressurization roller 44, a fixing belt 45, a gripping piece 49, a heat value adjustment member 61, and a coil unit 50. In the fixing apparatus 140 according to the second embodiment, only the composition of the heat value adjustment member 61 differs from that of the fixing apparatus 14 according to the first embodiment, and therefore description of the other members is omitted here.

In the fixing apparatus 140 according to the second embodiment, the heat value adjustment member 61 adjusts the amount of heat generated in the fixing belt 45 by generating heat itself. The heat value adjustment member 61 includes a base member 62 and a heat generating plate 63.

The base member 62 is a member having a cylindrical shape which is made of a non-magnetic resin material having high heat resistance, such as LCP, and extends in parallel with the pressurization roller 44 and is disposed in a position opposing the pressurization roller 44 via the nip section NP and the gripping piece 49. The heat value adjustment member 61 is composed so as to be rotatable in a prescribed direction. The base member 62 is a thin member having a thickness of 2 mm, for example.

The heat value adjustment member 61 sets the position of the fixing belt 45 with respect to the coil unit 50 by contacting the inner surface of the fixing belt 45 from the opposite direction to the direction in which the gripping piece 49 applies a gripping force to the fixing belt 45. The fixing belt 45 has intrinsic rigidity, and therefore the fixing belt 45 is supported by the heat value adjustment member 61 in a position opposing the center core 60 of the coil unit 50 and in a position in the vicinity thereof. Therefore, the fixing belt 45 does not contact the outer circumferential surface of the heat value adjustment member 61 except for at the position where the base member 62 opposes the center core 60 and a position in the vicinity thereof.

The heat generating plate 63 is a thin plate-shaped member made of a magnetic material, such as iron or stainless steel, and is installed on the outer circumferential surface of the base member 62. The heat generating plate 63 has a property that the plate generates heat when a magnetic flux generated by the coil 54 is passed therethrough. The thickness of the heat generating plate 63 is 0.3 to 1.0 mm, for example. The heat generating plate 63 is attached to the base member 62 by, for example, embedding the heat generating plate 63 following the outer circumferential surface of the base member 62. A coating layer (not illustrated) made of fluorine resin, for example, is formed on the surface of the heat value adjustment member 61, in other words, on substantially the whole surface of the heat generating plate 63 and the whole surface of the base member 62.

Figure 6:
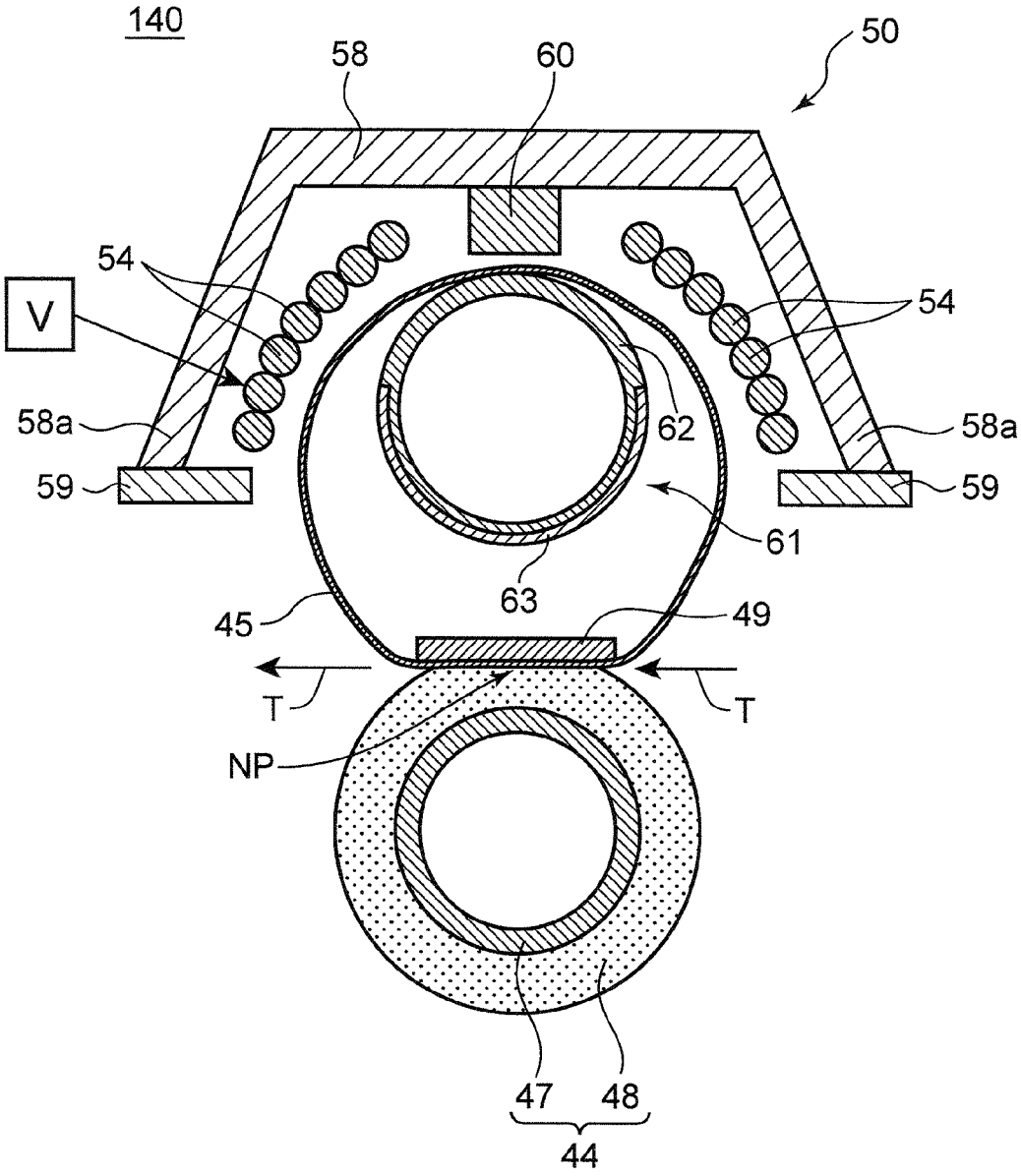

The position of the heat generating plate 63 is switched between a heat generating position and a restricted heat generating position, in accordance with rotation of the heat value adjustment member 61. FIG. 5 shows a state where the heat generating plate 63 is positioned in a heat generating position and FIG. 6 shows a state where the heat generating plate 63 is positioned in a restricted heat generating position. When positioned in the heat generating position, the heat generating plate 63 is at a position close to the center core 60, and generates heat due to the passage of the magnetic flux. On the other hand, when positioned in the restricted heat generating position, the heat generating plate 63 is at a position which is distant from the center core 60. Therefore, magnetic flux does not readily pass through the heat generating plate 63, and the generation of heat in the heat generating plate 63 is suppressed.

Figure 7:
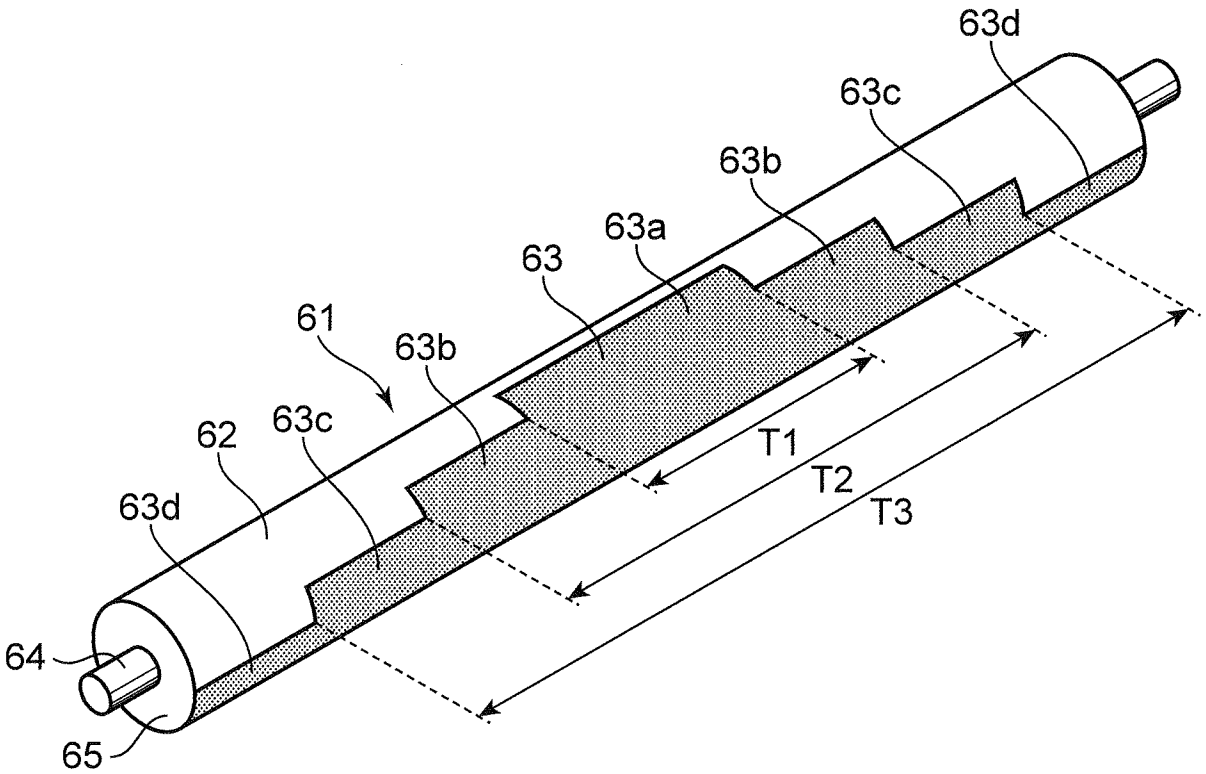
FIG. 7 is a perspective diagram of a heat value adjustment member which is used in a fixing apparatus according to the second embodiment.

FIG. 7 is a perspective diagram of the heat value adjustment member 61. As shown in FIG. 7, the heat generating plate 63 extends from one end portion to another end portion in the axial direction of the base member 62. The heat generating plate 63 has a circumferential dimension extending in the circumferential direction of the base member 62, and this circumferential dimension is set to become larger in the inward axial direction of the base member 62. More specifically, the heat generating plate 63 includes: a middle heat generating portion 63*a* which is disposed in the middle part of the axial direction of the base member 62, a pair of first heat generating portions 63*b* which are disposed respectively to the outside of the middle heat generating portion 63*a* in the axial direction of the base member 62, a pair of second heat generating portions 63*c* which are disposed respectively to the outside of the pair of first heat generating portions 63*b* in the axial direction of the base member 62, and a pair of third heat generating portions 63*d* which are disposed to the outside of the pair of second heat generating portions 63*c* in the axial direction of the base member 62, and more specifically, in the endmost portions of the base member 62 in the axial direction thereof. The middle heat generating portion 63*a* has the largest circumferential dimension, and the third heat generating portions 63*d* have the smallest circumferential dimension. The middle heat generating portion 63*a*, the first heat generating portions 63*b*, the second heat generating portions 63*c* and the third heat generating portions 63*d* are formed in an integrated fashion.

The middle heat generating portion 63*a*, the first heat generating portions 63*b*, the second heat generating portions 63*c* and the third heat generating portions 63*d* are arranged in accordance with the width dimensions of the sheets T which pass through the nip section NP. The middle heat generating portion 63*a* corresponds to a sheet T1 having a minimum width dimension (for example, an A5 sheet). The pair of first heat generating portions 63*b* correspond to a sheet T2 having a medium width dimension (for example, an A4 sheet (portrait)). The pair of second heat generating portions 63*c* correspond to a sheet T3 having a maximum width dimension (for example, an A3 sheet). The pair of third heat generating portions 63*d* are set to exceed the width dimension of the sheet T3. Furthermore, the respective circumferential dimensions of the middle heat generating portion 63*a*, the first heat generating portions 63*b*, the second heat generating portions 63*c* and the third heat generating portions 63*d* are set to dimensions which enable the heat generating plate 63 to receive the magnetic flux passing through the fixing belt 45 when the heat generating plate 63 is disposed in the heat generating position.

The base member 62 of the heat value adjustment member also includes flanges 65 which close off the respective end portions in the axial direction, and rotating shaft members 64 which pass through the flanges 65. By means of the rotating shaft member 64 rotating in a prescribed direction by mean of a drive source which is not illustrated, the position of the magnetic shielding plate 63 is switched between a heat generating position and a restricted heat generating position.

Next, a fixing operation by the fixing apparatus 140 relating to the second embodiment will be described. When an AC bias is applied to the coil 54 from the AC bias power source V, the coil 54 generates a magnetic flux. The magnetic flux passes along a magnetic path formed by the fixing belt 45, the side cores 59, the arch cores 58 and the center core 60. When the magnetic flux passes through the fixing belt 45, an induction current is generated. When the induction current is passed through the fixing belt 45, Joule heat is generated by the intrinsic resistance of the fixing belt 45 itself, in other words, induction heating occurs in the fixing belt 45. The whole of the fixing belt 45 inductively generates heat as the belt rotates. Furthermore, the heat generating plate 63 of the heat value adjustment member 61 generates heat by the magnetic flux which passes through the fixing belt 45.

In this case, the heat value adjustment member 61 is rotated appropriately by rotating the rotating shaft member 64 in accordance with the width dimension of the sheet T, and the positions of the middle heat generating portion 63*a* and the first heat generating portions 63*b* to the third heat generating portions 63*d* of the heat generating plate 63 are switched between a heat generating position and a restricted heat generating position.

For example, in the case of a sheet T1 having a minimum width dimension which is passing through the nip section NP, the heat value adjustment member 61 is rotated by the rotating shaft member 64 in such a manner that the middle heat generating portion 63*a* of the heat generating plate 63 is positioned in a heat generating position, whereas the first heat generating plates 63*b* to the third heat generating plates 63*d* are positioned in a restricted heat generating position. Consequently, generating heat is promoted in the paper passage region of the fixing belt 45 which is in contact with the sheet T1 in the nip section NP, whereas in the region outside the paper passage region of the fixing belt 45 which is not in contact with the sheet T1 in the nip section NP, generating heat is suppressed.

Furthermore, in the case of a sheet T2 having a medium width dimension which is passing through the nip section NP, the heat value adjustment member 61 is rotated by the rotating shaft member 64 in such a manner that the middle heat generating portion 63*a* and the pair of first heat generating portions 63*b* are positioned in a heat generating position, whereas the pair of second heat generating plates 63*c* and the pair of third heat generating plates 63*d* are positioned in a restricted heat generating position. Consequently, generating heat is promoted in the paper passage region of the fixing belt 45 which is in contact with the sheet T2 in the nip section NP, whereas in the region outside the paper passage region of the fixing belt 45 which is not in contact with the sheet T2 in the nip section NP, generating heat is suppressed.

Moreover, in the case of a sheet T3 having a maximum width dimension which is passing through the nip section NP, the heat value adjustment member 61 is rotated by the rotating shaft member 64 in such a manner that the middle heat generating portion 63*a*, the pair of first heat generating portions 63*b* and the pair of second heat generating portions 63*c* are positioned in a heat generating position, whereas the pair of third heat generating plates 63*d* are positioned in a restricted heat generating position. Consequently, generating heat is promoted in the paper passage region of the fixing belt 45 which is in contact with the sheet T3 in the nip section NP, whereas in the region outside the paper passage region of the fixing belt 45 which is not in contact with the sheet T3 in the nip section NP, generating heat is suppressed. The third heat generating portions 63*d* are never positioned in a heat generating position with respect to the sheets T1 to T3 of any of the sizes, and therefore they do not have to be formed on the base member 62.

In this way, by suitably rotating the heat value adjustment member 61 so as to switch the positions of the middle heat generating portion 63*a* and the first heat generating portions 63*b* to third heat generating portions 63*d*, between the heat generating position and the restricted heat generating position, generating heat is promoted in the paper passage region of the fixing belt 45, whereas overheating is suppressed in the region outside the paper passage region of the fixing belt 45. The positional relationships between the middle heat generating portion 63*a*, the first heat generating portions 63*b*, the second heat generating portions 63*c* and the third heat generating portions 63*d* are set so as to enable the middle heat generating portion 63*a*, the first heat generating portions 63*b*, the second heat generating portions 63*c* and the third heat generating portions 63*d* to be positioned appropriately in a heat generating position or a restricted heat generating position in accordance with the sheets T1 to T3.

When any one of the sheets T1, T2 or T3 enters into the nip section NP following the conveyance direction of the sheet T, the toner image on any one of the sheet T1, T2 or T3 receives heat from the fixing belt 45 while being gripped between the fixing belt 45 and the pressurization roller 44. By this means, the toner image is fixed onto the sheet.

In the fixing apparatus 140 relating to the second embodiment described above, a fixing belt 45 is wrapped between a gripping piece 49 and the heat value adjustment member 61, similarly to the fixing apparatus 14 relating to the first embodiment. Consequently, it is possible to reduce the amount of heat transferred from the fixing belt 45 which generates heat by using induction heating, compared to a conventional composition having a fixing belt which rotates by being wrapped about two roller members having a large heat capacity (for example, a fixing roller and a heating roller). Accordingly, it is possible to shorten the warm-up time of the fixing belt 45. Furthermore, since the heat value adjustment member 61 about which the fixing belt 45 is wrapped adjusts the amount of heat generated in the fixing belt 45, then it is possible to add a function of suppressing overheating of the fixing belt 45, to the fixing apparatus 140.

Furthermore, since the heat value adjustment member 61 is constituted by a thin base member 62 and thin plate-shaped heat generating plates 63, then the amount of heat transferred to the heat value adjustment member 61 from the fixing belt 45 generating heat by using induction heating is small. Moreover, if the heat generating plate 63 is disposed in the heat generating position, then the aforementioned effect is further enhanced, and in the case of a composition where the temperature of the heat generating plate 63 becomes higher than the temperature of the fixing belt 45, heat is transferred from the heat generating plate 63 to the fixing belt 45 and it is possible to heat the fixing belt 45 even more efficiently.

Furthermore, since the base member 62 of the heat value adjustment member 61 has a cylindrical shape, it is possible to rotate the heat generating plate 63 in a 360° angular range. By this means, the position of the heat generating plate 63 can be switched readily between a heat generating position and a restricted heat generating position.

Third Embodiment

Figure 8:
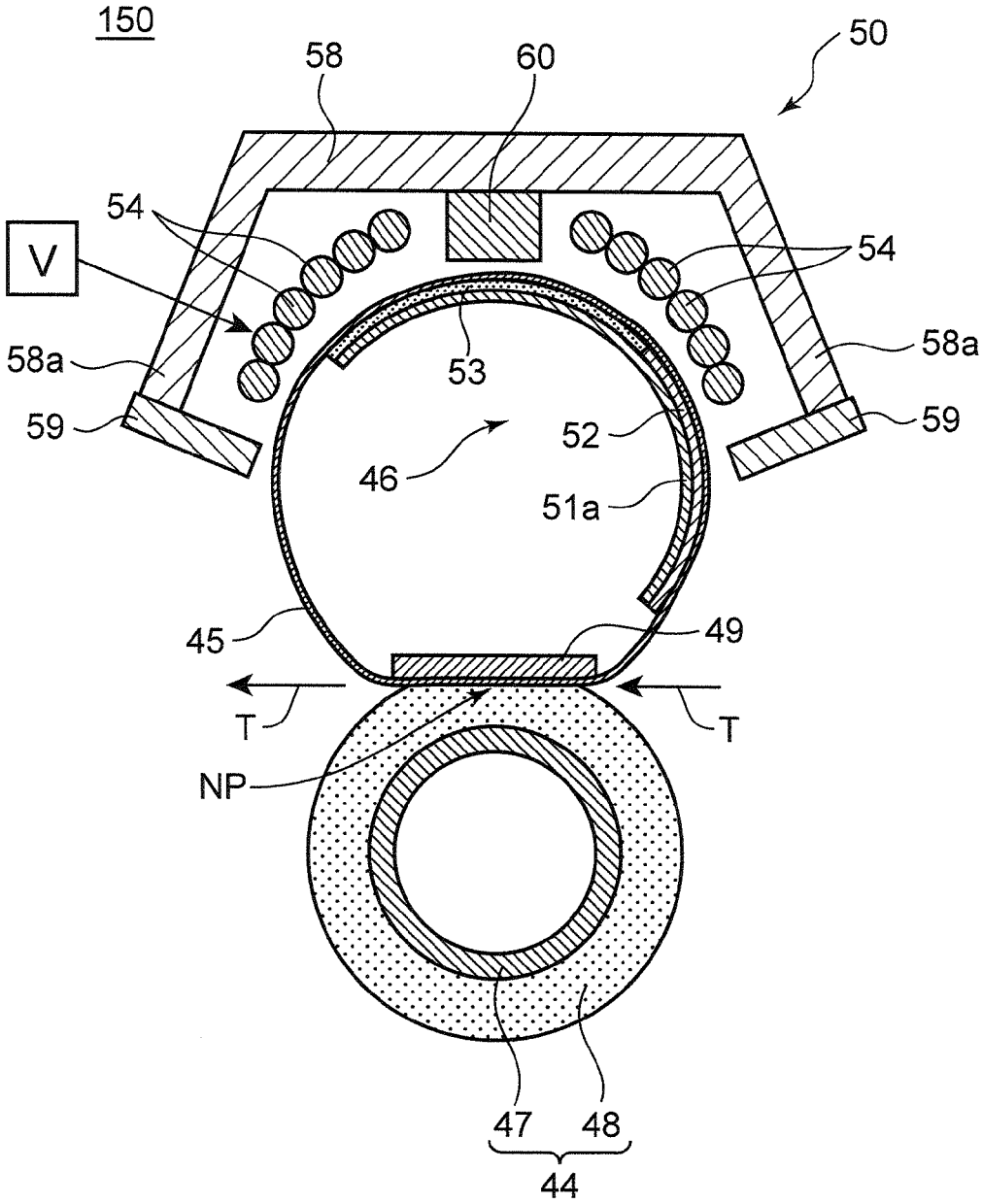
FIGS. 8 and 9 are longitudinal cross-sectional diagrams of a fixing apparatus relating to the third embodiment, where
Figure 9:
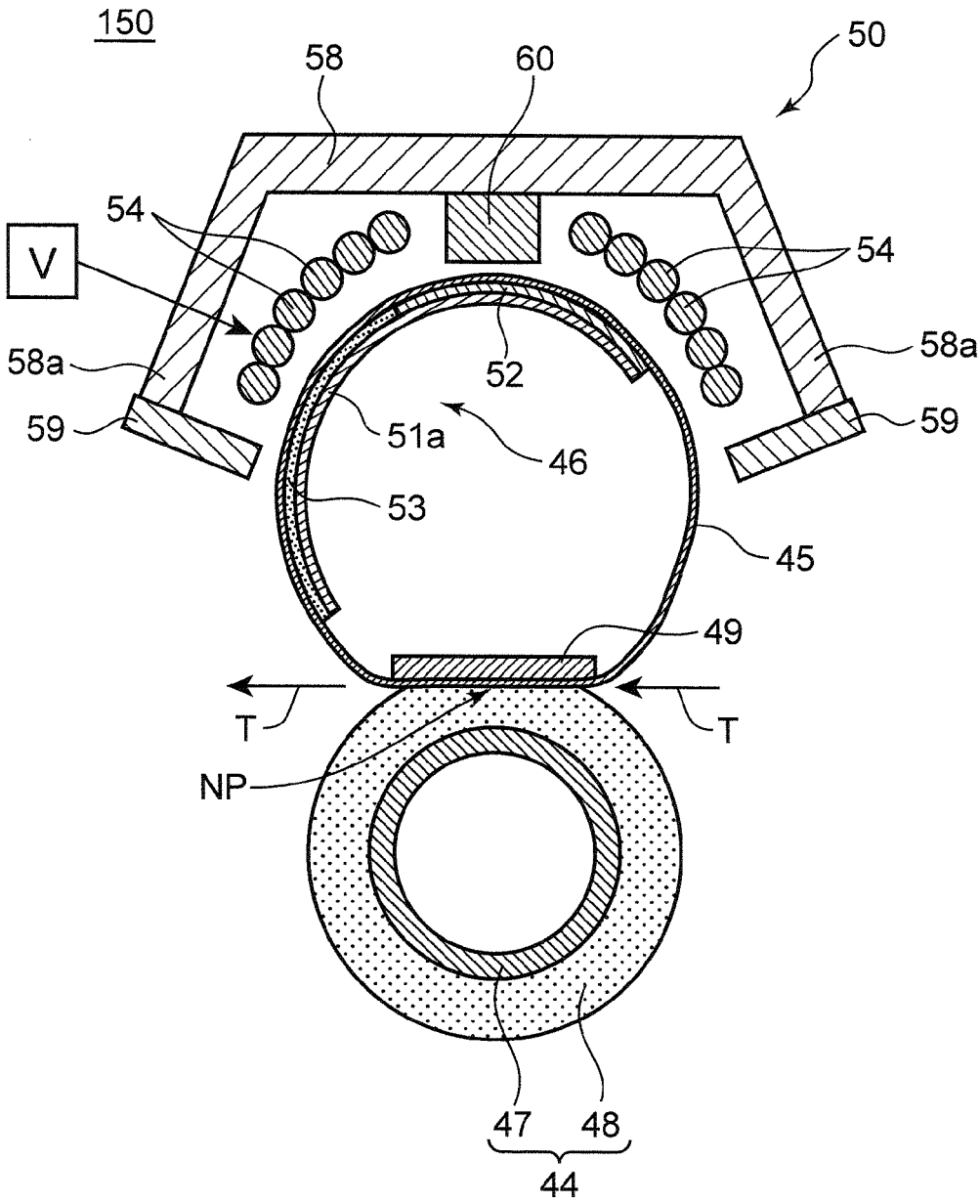

Next, a third embodiment of the disclosure is described with reference to FIG. 8 and FIG. 9. FIG. 8 is a longitudinal cross-sectional diagram of the fixing apparatus 150 relating to a third embodiment, and shows a state where a magnetic shielding plate 52 is positioned in a restricting shielding position. FIG. 9 is a longitudinal cross-sectional diagram of the fixing apparatus 150 relating to a third embodiment, and shows a state where a magnetic shielding plate 52 is positioned in a shielding position.

Similarly to the fixing apparatus 14 according to the first embodiment, the fixing apparatus 150 according to the third embodiment includes a pressurization roller 44, a fixing belt 45, a gripping piece 49, a heat value adjustment member 46, and a coil unit 50. In the fixing apparatus 150 according to the third embodiment, only the composition of the heat value adjustment member 46 differs from that of the fixing apparatus 14 according to the first embodiment, and therefore description of the other members is omitted here.

In the fixing apparatus 150 according to the third embodiment, the heat value adjustment member 46 which is used in the fixing apparatus 14 in the first embodiment has a semi-cylindrical shape, rather than a cylindrical shape. More specifically, the base member 51*a* of the heat value adjustment member 46 is formed with a semi-cylindrical shape, rather than a cylindrical shape. A magnetic shielding plate 52 and a coating layer 53 are provided on the base member 51*a* having the semi-cylindrical shape.

By rotating the heat value adjustment member 46 in a prescribed direction, the magnetic shielding plate 52 is switched between a shielding position where the magnetic shielding plate 52 is positioned so as to oppose the center core 60, and a restricted shielding position where the magnetic shielding plate 52 is positioned in a position distant from the center core 60. As stated previously, when the magnetic shielding plate 52 is positioned in the shielding position, the magnetic flux directed from the center core 60 to the fixing belt 45 is shielded or suppressed, whereas when the magnetic shielding plate 52 is positioned in the restricted shielding position, the shielding of the magnetic flux is weakened. In the third embodiment, the central angle of the coil 54 which covers the fixing belt 45 is set to approximately 100° to 120°, the central angle of the base member 51*a* is set to approximately 180° to 200°, and the central angle of the magnetic shielding plate 52 is set to approximately 60° to 90°. As mentioned above, the position of the magnetic shielding plate 52 is switched appropriately between a shielding position and a restricted shielding position in accordance with the sheets T1 to T3 which pass through the nip section NP.

According to the fixing apparatus 150 relating to the third embodiment, the heat value adjustment member 46 is formed in a semi-cylindrical shape, and therefore it is possible to further reduce the heat capacity of the heat value adjustment member 46 compared to a composition where the heat value adjustment member is formed in a cylindrical shape. The amount of heat transferred from the fixing belt 45 which generates heat by using induction heating to the heat value adjustment member 46 is reduced accordingly. Consequently, it is possible further to shorten the warm-up time of the fixing belt 45.

Fourth Embodiment

Figure 10:
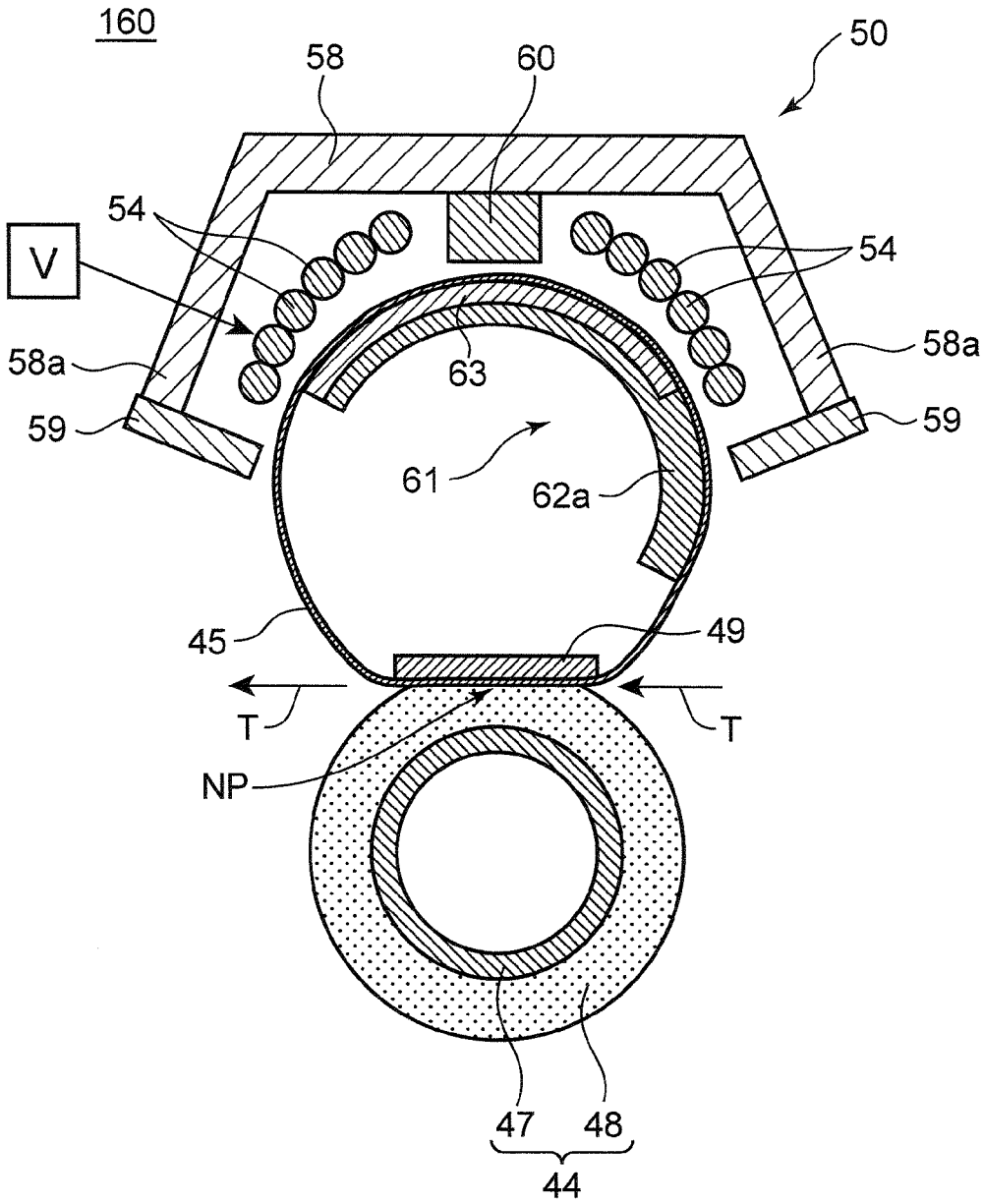
FIGS. 10 and 11 are longitudinal cross-sectional diagrams of a fixing apparatus relating to a fourth embodiment, where
Figure 11:
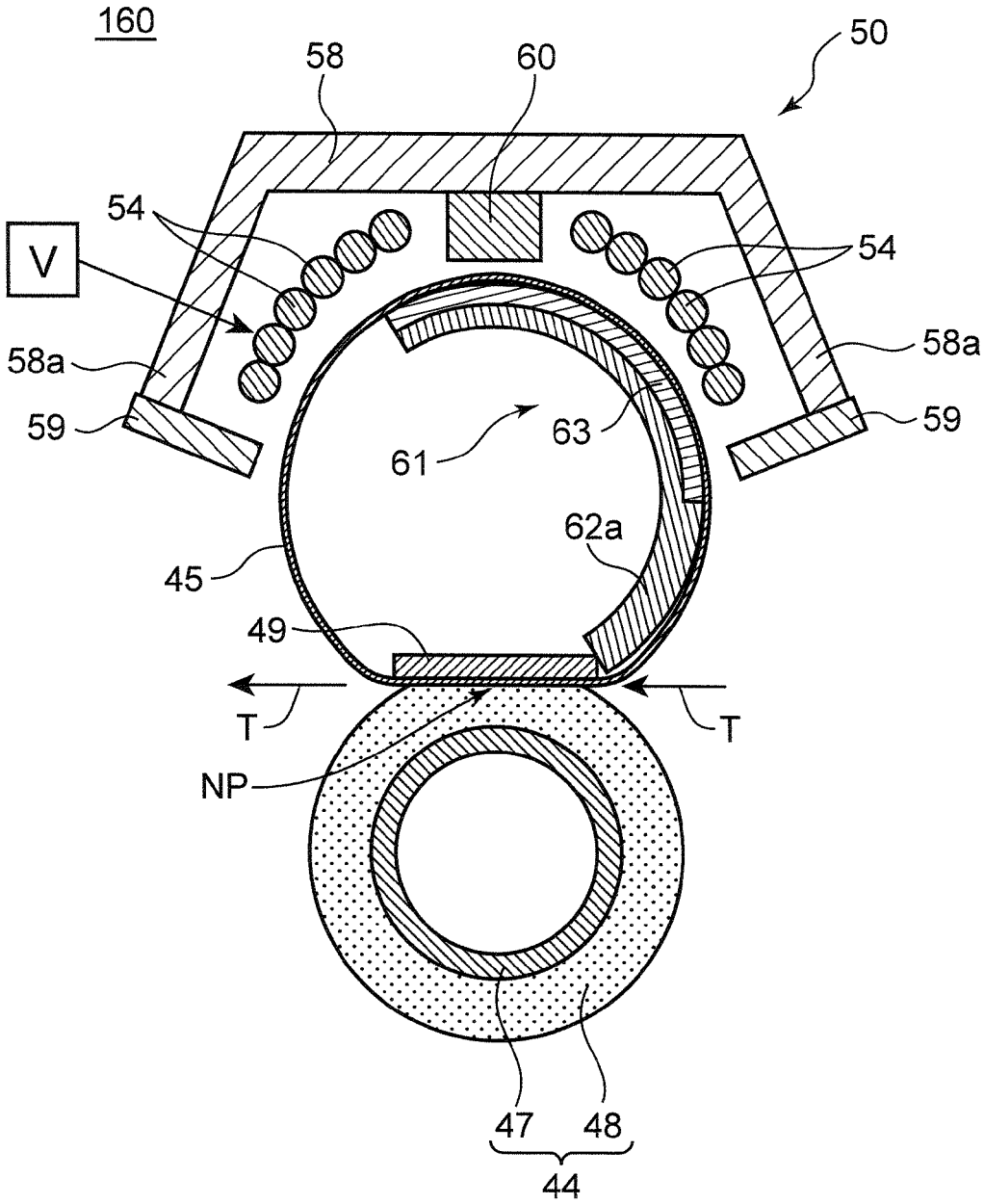

Next, a fixing apparatus 160 relating to a fourth embodiment is described with reference to FIG. 10 and FIG. 11. FIG. 10 is a longitudinal cross-sectional diagram of the fixing apparatus 160 relating to a fourth embodiment, and shows a state where a heat generating plate 63 is positioned in a heat generating position. FIG. 11 is a longitudinal cross-sectional diagram of a fixing apparatus 160, and shows a state where the heat generating plate 63 is positioned in a restricted heat generating position.

Similarly to the fixing apparatus 140 according to the second embodiment, the fixing apparatus 160 according to the fourth embodiment includes a pressurization roller 44, a fixing belt 45, a gripping piece 49, a heat value adjustment member 61, and a coil unit 50. In the fixing apparatus 160 according to the fourth embodiment, only the composition of the heat value adjustment member 61 differs from that of the fixing apparatus 140 according to the second embodiment, and therefore description of the other members is omitted here.

In the fixing apparatus 160 according to the fourth embodiment, the heat value adjustment member 61 which is used in the fixing apparatus 140 in the second embodiment has a semi-cylindrical shape, rather than a cylindrical shape. More specifically, the base member 62*a* of the heat value adjustment member 61 is formed with a semi-cylindrical shape, rather than a cylindrical shape. A heat generating plate 63 and a coating layer (not illustrated) are provided on the base member 62*a* having a semi-cylindrical shape. The structure of the heat generating plate 63 is as shown in FIG. 7.

By rotating the heat value adjustment member 61 in a prescribed direction, the heat generating plate 63 is switched between a heat generating position where the heat generating plate 63 is opposes the major part of the center core 60 and the coil 54, and generates heat due to the passage of magnetic flux, and a restricted heat generating position where the heat generating plate 63 is away from the center core 60 and generation of heat is suppressed. In FIG. 10, each one of the middle heat generating portion 63*a* and the first heat generating portions 63*b* to the third heat generating portions 63*d* have been moved to positions opposing the major part of the center core 60 and the coil 54, and hence are positioned in the heat generating position. In FIG. 11, only the middle heat generating portion 63*a* has been moved to a position opposing the center core 60 and hence is in a heat generating position, whereas the first to third heat generating portions 63*b* to 63*d* have been moved to a position distant from the center core 60 and hence are positioned in a restricted heat generating position.

In the fourth embodiment, the central angle of the coil 54 which covers the fixing belt 45 is set to approximately 100° to 120°, the central angle of the middle heat generating portion 63*a* of the heat generating plate 63 is set to approximately 180° to 200°, and the central angle of the third heat generating portions 63*d* of the magnetic shielding plate 63 is set to approximately 100° to 120°. As mentioned above, the position of the heat generating plate 63 is switched appropriately between a heat generating position and a restricted heat generating position in accordance with the sheets T1 to T3 which pass through the nip section NP.

According to the fixing apparatus 160 relating to the fourth embodiment, the base member 62*a* of the heat value adjustment member 61 is formed in a semi-cylindrical shape, and therefore it is possible to reduce the heat capacity of the heat value adjustment member 61 in comparison with a composition where the base member 62 is formed in a cylindrical shape. The amount of heat transferred from the fixing belt 45 which generates heat by using induction heating to the heat value adjustment member 61 is reduced accordingly. Consequently, it is possible further to shorten the warm-up time of the fixing belt 45.

According to the fixing apparatus and the image forming apparatus relating to the present disclosure which were described above, it is possible to shorten the warm-up time of a belt, while providing a function of suppressing overheating of the belt.

This application is based on Japanese Patent application No. 2010-199166 filed in Japan Patent Office on Sep. 6, 2010, the contents of which are hereby incorporated by reference.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

What is claimed is:

1. A fixing apparatus, comprising:

a magnetic flux generating source which generates a magnetic flux;

an endless belt which inductively generates heat by the magnetic flux passing through the belt while rotating in a prescribed direction;

a rotating body which rotates in a prescribed direction and, together with the belt, forms a nip section through which a recording medium carrying a toner image passes;

a core which is made of a magnetic material, and directs the magnetic flux to the belt;

a heat value adjustment member that is disposed rotatably and adjusts an amount of heat generated in the belt, the heat value adjustment member being disposed to oppose the magnetic flux generating source and the core across the belt; and a gripping piece which is a non-rotating member, is disposed in a position corresponding to the nip section, and contacts an inner surface of the belt to rotatably grip the belt against the rotating body;

wherein the belt is wrapped between the heat value adjustment member and the gripping piece, and the heat value adjusting member is rotated in accordance with a width dimension of a recording medium in a direction perpendicular to a conveyance direction of the recording medium passing through the nip section so that overheating is suppressed in the region outside the recording medium passage region of the belt, the magnetic flux generating source is a winding disposed to oppose the outer circumferential surface of the belt at a position opposite to the rotating body with respect to the belt, the core has a center core surrounded by the magnetic flux generating source and opposes the belt in a region where the magnetic flux generating source is not present, and the belt has a prescribed rigidity and contacts an outer circumferential surface of the heat value adjustment member at a position where the heat value adjustment member opposes the center core and a position in the vicinity thereof, and the belt does not contact the outer circumferential surface of the heat value adjustment member at a position where the heat value adjustment member opposes the magnetic flux generating source.

2. The fixing apparatus according to claim 1, wherein the heat value adjustment member has a coating layer which reduces friction between a surface of the heat value adjustment member and the inner surface of the belt.

3. The fixing apparatus according to claim 1, wherein the heat value adjustment member includes:

a thin base member made of a magnetic material; and a thin plate-shaped magnetic shielding plate which is made of a non-magnetic material, and is installed on an opposite surface of the base member from the belt; and wherein the position of the magnetic shielding plate is switched between a shielding position for shielding or suppressing the magnetic flux and a restricted shielding position where shielding of the magnetic flux is restricted, in accordance with rotation of the base member; and the amount of generated heat is adjusted by switching the position of the magnetic shielding plate between the shielding position and the restricted shielding position.

4. The fixing apparatus according to claim 3, wherein the base member has a semi-cylindrical shape.

5. The fixing apparatus according to claim 3, wherein the base member has a cylindrical shape.

6. The fixing apparatus according to claim 1, wherein the gripping piece is a flat plate-shaped member extending along the nip section in parallel with the rotating body.

7. The fixing apparatus according to claim 1, wherein the heat value adjustment member includes:

a thin base member made of a non-magnetic material; and a thin plate-shaped heat generating plate which is made of a magnetic material capable of generating heat by the magnetic flux, and is installed on an opposite surface of the base member from the belt; and wherein the position of the heat generating plate is switched between a heat generating position for generating heat by the magnetic flux and a restricted heat generating position where generation of heat is restricted, in accordance with rotation of the base member; and the amount of generated heat is adjusted by switching the position of the heat generating plate between the heat generating position and the restricted heat generating position.

8. The fixing apparatus according to claim 7, wherein the base member has a semi-cylindrical shape.

9. The fixing apparatus according to claim 7, wherein the base member has a cylindrical shape.

10. An image forming apparatus, comprising:

an image forming unit which forms a toner image;

a transfer unit which transfers the toner image formed by the image forming unit onto a recording medium; and a fixing apparatus which fixes the toner image onto the recording medium;

wherein the fixing apparatus includes:

a magnetic flux generating source which generates a magnetic flux;

an endless belt which inductively generates heat by the magnetic flux while rotating in a prescribed direction;

a rotating body which rotates in a prescribed direction and, together with the belt, forms a nip section through which the recording medium carrying the toner image passes;

a core which is made of a magnetic material, and directs the magnetic flux to the belt;

a heat value adjustment member that is disposed rotatably and adjusts an amount of heat generated in the belt, the heat value adjustment member being disposed to oppose the magnetic flux generating source and the core across the belt; and a gripping piece which is a non-rotating member, is disposed in a position corresponding to the nip section, and contacts an inner surface of the belt to rotatably grip the belt against the rotating body; and wherein the belt is wrapped between the heat value adjustment member and the gripping piece, and the heat value adjusting member is rotated in accordance with a width dimension of a recording medium in a direction perpendicular to a conveyance direction of the recording medium passing through the nip section so that overheating is suppressed in the region outside the recording medium passage region of the belt, the magnetic flux generating source is a winding disposed to oppose the outer circumferential surface of the belt at a position opposite to the rotating body with respect to the belt, the core has a center core surrounded by the magnetic flux generating source and opposes the belt in a region where the magnetic flux generating source is not present, and the belt has a prescribed rigidity and contacts an outer circumferential surface of the heat value adjustment member at a position where the heat value adjustment member opposes the center core and a position in the vicinity thereof, and the belt does not contact the outer circumferential surface of the heat value adjustment member at a position where the heat value adjustment member opposes the magnetic flux generating source.

11. The image forming apparatus according to claim 10, wherein the heat value adjustment member has a coating layer which reduces friction between a surface of the heat value adjustment member and the inner surface of the belt.

12. The image forming apparatus according to claim 10, wherein the heat value adjustment member includes:

a thin base member made of a magnetic material; and a thin plate-shaped magnetic shielding plate which is made of a non-magnetic material, and is installed on an opposite surface of the base member from the belt; and wherein the position of the magnetic shielding plate is switched between a shielding position for shielding or suppressing the magnetic flux and a restricted shielding position where shielding of the magnetic flux is restricted, in accordance with rotation of the base member; and the amount of generated heat is adjusted by switching the position of the magnetic shielding plate between the shielding position and the restricted shielding position.

13. The image forming apparatus according to claim 12, wherein the base member has a semi-cylindrical shape.

14. The image forming apparatus according to claim 12, wherein the base member has a cylindrical shape.

15. The image forming apparatus according to claim 10, wherein the gripping piece is a flat plate-shaped member extending along the nip section in parallel with the rotating body.

16. The image forming apparatus according to claim 10, wherein the heat value adjustment member includes:

a thin base member made of a non-magnetic material; and a thin plate-shaped heat generating plate which is made of a magnetic material capable of generating heat by the magnetic flux, and is installed on an opposite surface of the base member from the belt; and wherein the position of the heat generating plate is switched between a heat generating position for generating heat by the magnetic flux and a restricted heat generating position where generation of heat is restricted, in accordance with rotation of the base member; and the amount of generated heat is adjusted by switching the position of the heat generating plate between the heat generating position and the restricted heat generating position.

17. The image forming apparatus according to claim 16, wherein the base member has a semi-cylindrical shape.

18. The image forming apparatus according to claim 16, wherein the base member has a cylindrical shape.

19. A fixing apparatus, comprising:

a magnetic flux generating source which generates a magnetic flux;

an endless belt which inductively generates heat by the magnetic flux passing through the belt while rotating in a prescribed direction;

a rotating body which rotates in a prescribed direction and, together with the belt, forms a nip section through which a recording medium carrying a toner image passes;

a core which is made of a magnetic material, and directs the magnetic flux to the belt;

a heat value adjustment member that is disposed rotatably and adjusts an amount of heat generated in the belt; and a gripping piece which is a non-rotating member, is disposed in a position corresponding to the nip section, and contacts an inner surface of the belt to rotatably grip the belt against the rotating body;

wherein the belt is wrapped between the heat value adjustment member and the gripping piece, and the heat value adjusting member is rotated in accordance with a width dimension of a recording medium in a direction perpendicular to a conveyance direction of the recording medium passing through the nip section so that overheating is suppressed in the region outside the recording medium passage region of the belt, and the heat value adjustment member includes:

a thin cylindrical base member made of a non-magnetic material; and a thin plate-shaped heat generating plate which is made of a magnetic material capable of generating heat by the magnetic flux, and is installed on an opposite circumferential surface of the base member from the belt; and wherein the position of the heat generating plate is switched between a heat generating position for generating heat by the magnetic flux and a restricted heat generating position where generation of heat is restricted, in accordance with rotation of the base member; and the amount of generated heat is adjusted by switching the position of the heat generating plate between the heat generating position and the restricted heat generating position.

* * * * *